US005320419A

United States Patent [19]

Inagawa

[11] Patent Number: 5,320,419

[45] Date of Patent: Jun. 14, 1994

[54] PARKING BRAKE CIRCUIT FOR HYDRAULICALLY DRIVEN VEHICLE

[76] Inventor: Makoto Inagawa, 3-20-1, Nakaze, Kawasaki-ku,, Kawasaki-shi, Kanagawa-ken 210, Japan

[21] Appl. No.: 613,625

[22] PCT Filed: Mar. 16, 1990

[86] PCT No.: PCT/JP90/00357

§ 371 Date: Mar. 16, 1991

§ 102(e) Date: Mar. 16, 1991

[87] PCT Pub. No.: WO90/10757

PCT Pub. Date: Sep. 20, 1990

[30] Foreign Application Priority Data

Mar. 16, 1989 [JP] Japan ..... 1-29044

[51] Int. Cl.[5] ..... E02F 9/22

[52] U.S. Cl. ..... 303/11; 303/72

[58] Field of Search ..... 303/DIG. 5, DIG. 6, 303/84.1, 84.2, 13, 14, 11, 5, 72, DIG. 900, DIG. 901, 43, 71; 188/170

[56] References Cited

U.S. PATENT DOCUMENTS

| | | | |
|---|---|---|---|
| 3,743,162 | 7/1973 | Gage | 303/13 X |
| 4,057,298 | 11/1977 | Seegers | 303/84.1 |
| 4,244,276 | 1/1981 | Iwata | 91/447 |
| 4,478,318 | 10/1984 | Hayden | 303/84.2 X |
| 4,645,271 | 2/1987 | Brearey et al. | 303/14 |

FOREIGN PATENT DOCUMENTS

| | | | |
|---|---|---|---|
| 1363931 | 3/1963 | France | 303/13 |
| 61-041663 | 2/1986 | Japan . | |
| 0041663 | 2/1986 | Japan | 303/11 |
| 0438805 | 2/1975 | U.S.S.R. | 303/13 |
| 1511164 | 9/1989 | U.S.S.R. | 303/11 |

*Primary Examiner*—Robert J. Oberleitner
*Assistant Examiner*—Josie A. Ballato

[57] ABSTRACT

A parking brake circuit for a hydraulically driven vehicle which prevents the occurrence of an erroneous operation at the time when the vehicle travels on a downward slope. The parking brake circuit comprises first and second main circuits (2, 3) for supplying hydraulic operating fluid into a hydaulically driven motor (1) for traveling the vehicle. A counterbalance valve (4) provided between these main circuits for feeding hydraulic operating fluid on the side of high hydraulic pressure into a pressure receiving chamber (6a) of a parking brake actuating actuator (6). A conduit (5) for connecting an outlet port of the counterbalance valve to the pressure receiving chamber, and a slow return valve (12) are provided in the conduit so as to control a flow of hydraulic operating fluid directed from the pressure receiving chamber to the counterbalance valve.

2 Claims, 2 Drawing Sheets

PARKING BRAKE CIRCUIT FOR HYDRAULICALLY DRIVEN VEHICLE

TECHNICAL FIELD OF THE INVENTION

This invention relates to a parking brake circuit for a hydraulically driven construction vehicle such as, for example, a power shovel, and the like, and more particularly to such a parking brake circuit being adapted to prevent an erroneous operation when the vehicle travels on a downward slope.

BACKGROUND ART OF THE INVENTION

Heretofore, a parking brake circuit as shown in FIG. 1 has been known. This prior art parking brake circuit is constructed such that, in order to introduce hydraulic operating fluid having a high pressure into a conduit 5, first and second main circuits 2, 3 are connected to first and second ports 1*a*, 1*b* of a hydraulically driven motor 1 for driving a vehicle, respectively, and further a counterbalance valve 4 is provided between the main circuits 2, 3, and still further one end of the conduit 5 is connected to a pressure receiving chamber 6*a* of an actuator 6 for actuating a parking brake. The parking brake circuit is adapted to release a parking brake 7 when hydraulic operating fluid is supplied into the pressure receiving chamber 6*a* of the parking brake actuating actuator 6 and, on the other hand, to operate or apply the parking brake 7 by the action of a compression spring and the like when the hydraulic operating fluid is discharged from the pressure receiving chamber 6*a*. In addition, in the parking brake circuit when the hydraulically driven motor 1 is driven by supplying hydraulic operating fluid through an operation valve not shown into either one of the first and the second main circuit 2, 3, the parking brake 7 is released. On the other hand, when the rotating operation of the hydraulically driven motor 1 is stopped by interrupting the supply of hydraulic operating fluid into the first and the second main circuits 2, 3, the parking brake 7 is applied or operated.

In the above described parking brake circuit, since the parking brake is released by the utilization of hydraulic operating fluid within either one of the first and the second main circuits 2, 3, which has become a high hydraulic pressure side. When either one of the first and the second main circuits 2, 3, on the side of high hydraulic pressure, becomes a low pressure (i.e., less than such a hydraulic pressure as releases the parking brake) because of a pumping operation of the hydraulically driven motor 1 caused, for example, by the vehicle travelling on a downward slope, the parking brake 7 is rendered operative undesirably so as to stop the rotating operation of the hydraulically driven motor 1.

SUMMARY OF THE INVENTION

The present invention has been made in view of the above-described circumstances, and has for its aim to provide a parking brake circuit for a hydraulically driven vehicle which can prevent the occurrence of an erroneous operation when the vehicle travels on a downward slope.

In order to achieve the above aim, according to one aspect of the present invention, there is provided a parking brake circuit for a hydraulically driven vehicle, comprising: a hydraulically driven motor; first and second main circuits connected to first and second ports, respectively, of the hydraulically driven motor so as to introduce hydaulic operating fluid from a supply source thereof into the motor; a parking brake actuator for rendering a parking brake operative/inoperative, the parking brake being so mounted as to brake a drive shaft of the hydraulically driven motor, the parking brake actuator being adapted to render the parking brake inoperative when hydraulic operating fluid is supplied into a pressure receiving chamber of the actuator and, on the other hand, to render the parking brake operative when the hydraulic operating fluid is discharged from the pressure receiving chamber thereof; a counterbalance valve provided between the first and the second main circuits so as to feed hydraulic operating fluid within either one of the first and the second main circuits which has become a high hydraulic pressure side; and a conduit provided so as to connect an outlet port of the counterbalance valve with the pressure receiving chamber of the parking brake actuator; the improvement characterized in that a slow return valve for controlling a flow of hydraulic operating fluid directed from the pressure receiving chamber of the parking brake actuator to the counterbalance valve is provided in the conduit.

According to the parking brake circuit of the present invention having the above described aspect, it becomes possible to prevent a hydraulic pressure within the pressure receiving chamber of the parking brake actuator from lowering to less than such a hydraulic pressure as releases the parking brake by controlling the flow of hydraulic operating fluid directed from the pressure receiving chamber to the counterbalance valve.

Accordingly, the circuit can be prevented to render the parking brake operative undesirably, thereby stopping the rotating operation of the hydraulically driven motor, even when the motor conducts a pumping operation at the time when the vehicle travels on a downward slope.

The above and many other advantages, features and additional aims of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENT

Figure 2:
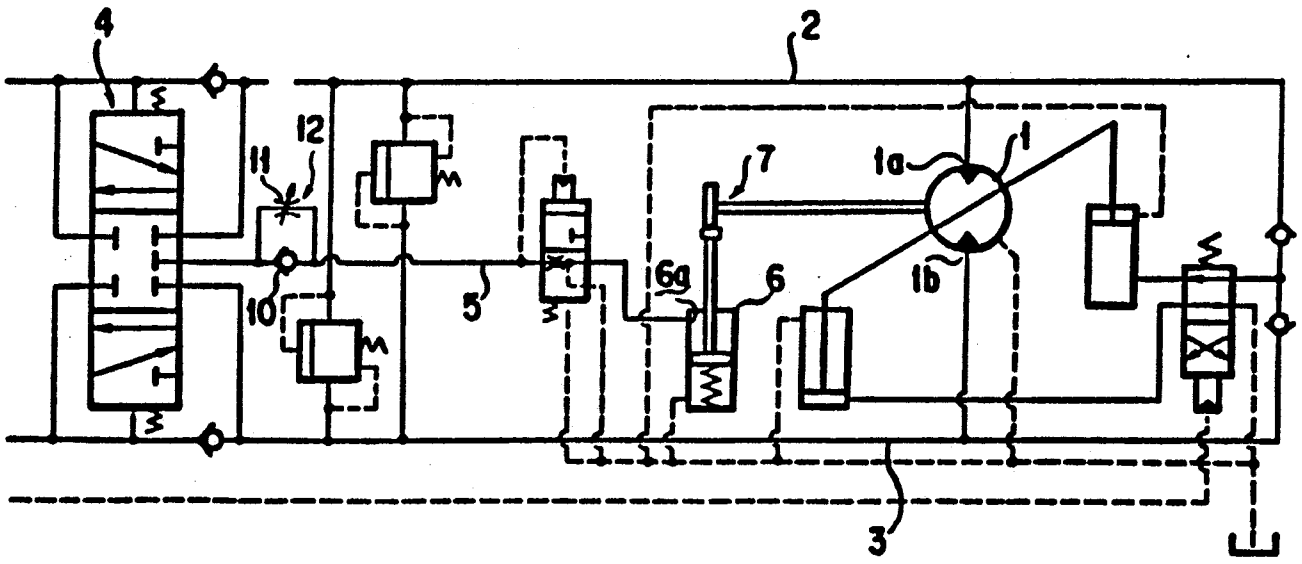
FIG. 2 is a hydraulic circuit diagram showing one embodiment of the present invention.

Hereinafter, the present invention is further described in detail with reference to an embodiment shown in the accompanying drawings (FIG. 2).

Figure 1:
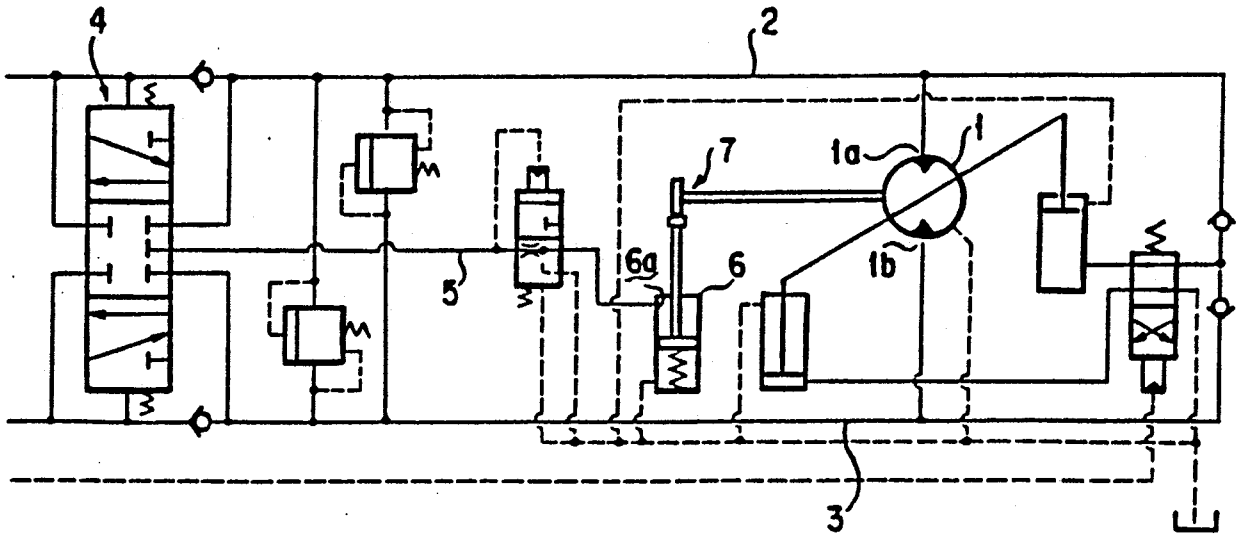
FIG. 1 (PRIOR ART)
FIG. 1 is a hydraulic circuit diagram showing an embodiment as the prior art.

FIG. 2 is a hydraulic circuit diagram showing one embodiment of the present invention. The descriptions in regard to construction elements with the same reference numerals and reference symbols as in the prior art embodiment shown in FIG. 1 and already described above are omitted to avoid a repetition and to simplify the explanation, because these elements have the same operative functions, respectively.

As is shown in FIG. 2, a slow return valve 12 consisting of a directional control check valve 10 and a by-pass circuit with an adjustable restrictor 11 is provided in a conduit 5 connected between a counterbalance valve 4 and a pressure receiving chamber 6a of a parking brake actuator 6. Therefore, a hydraulic pressure within the pressure receiving chamber 6a of the parking brake actuator 6 can be prevented from lowering less than such a hydraulic pressure as releases the parking brake even when the hydraulic pressure within either one of the first and the second main circuits 2, 3 which has been on the side of a high hydraulic pressure is lowered, because it is regulated by the provision of the slow return valve to flow out the hydraulic operating fluid within the pressure receiving chamber 6a of the parking brake actuator 6 through the counterbalance valve 4 into a hydraulic circuit on the side of a low hydraulic pressure.

I claim:

1. A parking brake circuit for a hydraulically driven vehicle, comprising: a hydraulically driven motor; first and second main circuits connected to first and second ports, respectively, of the hydraulically driven motor so as to introduce hydraulic operating fluid from a supply source thereof into said motor; a parking brake actuator for rendering a parking brake operative or inoperative, said parking brake being so mounted as to brake a drive shaft of the hydraulically driven motor, said parking brake actuator including a pressure receiving chamber and being adapted to render the parking brake inoperative when hydraulic operating fluid is supplied into said pressure receiving chamber of said actuator and, on the other hand, to render the parking brake operative when the hydraulic operating fluid is discharged from said pressure receiving chamber;

a counterbalance valve provided between said first and the second main circuits so as to feed hydraulic operating fluid within either one of said first and the second main circuits which has become a high hydraulic pressure side; and a conduit provided so as to connect an outlet port of said counterbalance valve with said pressure receiving chamber of said parking brake actuator; the improvement characterized in a slow return valve for controlling a flow of hydraulic operating fluid directed from said pressure receiving chamber of said parking brake actuator to the counterbalance valve, said slow return valve comprising a directional control check valve for checking a flow of hydraulic operating fluid directed to a hydraulic circuit which is on the side of low hydraulic pressure, and a by-pass circuit with an adjustable restrictor.

2. A parking circuit for a hydraulically driven vehicle, comprising:

a hydraulically driven motor having first and second ports and a drive shaft;

a hydraulic fluid source operably connected to said motor to supply a hydraulic operating fluid to said motor;

first and second main circuits connected to said first and second ports of the motor, respectively;

a parking brake actuator means for rendering a parking brake of a vehicle mounted to said drive shaft of said motor, said parking brake actuator means including a pressure receiving chamber and being adapted to render the parking brake inoperative when the hydraulic operating fluid is discharged from said pressure receiving chamber thereof;

a counterbalance valve provided between said first and second main circuits so as to feed the hydraulic operating fluid within either one of said first and second main circuits which has become a high hydraulic pressure side;

a conduit means connecting an outlet port of said counterbalance valve and said pressure receiving chamber of said actuator means; and a slow return valve means incorporated in said conduit means for controlling a flow of the hydraulic operating fluid directed from said pressure receiving chamber to said counterbalance valve, said slow return valve means including a valve for checking a flow of the hydraulic operating fluid directed to a hydraulic circuit which is on a side of a low hydraulic pressure, and a by-pass circuit having an adjustable restrictor means and by-passing the check valve.

* * * * *

UNITED STATES PATENT AND TRADEMARK OFFICE

CERTIFICATE OF CORRECTION

PATENT NO. : 5,320,419

DATED : June 14, 1994

INVENTOR(S) : Inagawa

It is certified that error appears in the above-indentified patent and that said Letters Patent is hereby corrected as shown below:

On the title page: Item [73] Assignee

—KABUSHIKI KAISHA KOMATSU SEISAKUSHO —.

Signed and Sealed this

Eighth Day of November, 1994

*Attest:*

Bruce Lehman

BRUCE LEHMAN

*Attesting Officer*

*Commissioner of Patents and Trademarks*